United States Patent [19]

Nicholson

[11] 4,063,318

[45] Dec. 20, 1977

[54] FOLDING FRAME ASSEMBLY

[76] Inventor: Oscar F. Nicholson, 320 Spencer St., Orlando, Fla. 32809

[21] Appl. No.: 745,064

[22] Filed: Nov. 26, 1976

[51] Int. Cl.[2] ..... A47C 21/00

[52] U.S. Cl. ..... 5/327 R; 135/5 R; 297/184

[58] Field of Search ..... 5/327 R, 327 B; 248/118; 297/184; 135/5 R

[56] References Cited

U.S. PATENT DOCUMENTS

| | | | |
|---|---|---|---|
| 1,921,984 | 8/1933 | Moore | 135/5 R X |
| 3,007,735 | 11/1961 | Cohn | 297/184 |
| 3,241,160 | 3/1966 | Escobar | 297/184 X |

FOREIGN PATENT DOCUMENTS

| | | | |
|---|---|---|---|
| 143,943 | 10/1951 | Australia | 135/5 R |
| 707,953 | 4/1954 | United Kingdom | 297/184 |

*Primary Examiner*—James C. Mitchell

*Attorney, Agent, or Firm*—Duckworth, Hobby & Allen

[57] ABSTRACT

A folding frame assembly of the type suitable for providing support for a covering material whereby the user's head may be commfortably supported and his face may be shielded from the sun's rays.

1 Claim, 7 Drawing Figures

FOLDING FRAME ASSEMBLY

BACKGROUND OF THE INVENTION

1. Field of the Invention

The present invention relates to a folding frame assembly, portions of which will provide support for a covering material. The frame assembly may be easily collpased, or folded, for storage and transportation. When open, the assembly provides support for the user's head when the user is in a reclining position, while at the same time providing an effective shade to protect the user's face from the sun's rays.

2. Description of the Prior Art

Numerous varieties of and constructions for folding or collapsible furniture are known in the prior art. Specifically, many such devices are intended for use in outdoor environments such as, for example, around swimming pools or at beaches. Such devices are normally constructed from pivotally connected frame members having fabric supports extending across predetermined portions of the frame members.

Such devices take a variety of shapes and configurations and may comprise umbrellas, chairs, lounges, cots, etc. For example, U.S. Pat. No. 2,888,689, discloses an article of tubular furniture including a plurality of tubes pivotally mounted in a base wherein the tubes are adapted to be selectively extended to support a sheet of material to form a chair or couch. Additionally, the tubes comprising the frame of this invention may be folded into a substantially parallel position for storage, shipping and transportation. A folding structure, intended specifically as a headrest, in disclosed in U.S. Pat. No. 3,305,201. The device disclosed therein basically comprises a tripod-like frame including a substantially triangular headrest and a removably attachable sunscreen. According to the disclosure of that patent, the sunscreen may also be positioned for use as a table surface. However, it should be noted that when the device of U.S. Pat. No. 3,305,201, is collapsed, or folded, the device will comprise three, separate, distinct elements: a frame, a headrest, and a sunscreen.

Many prior art devices share this common problem of having to be broken down into discrete component parts when the devices are collapsed for storage or transportation. This, of course, may lead to the inadvertant loss of one or more component elements, resulting in the ultimate inoperability of such devices because of a missing element. Additionally, since the most such prior art devices include frame structures formed from substantially tubular material, their legs or base members tend to dig into and bury themselves in a soft supporting surface, such as beach sand. Additionally, very few prior art devices provide the dual function of simultaneously supporting a predetermined portion of the user's body while at the same time shielding the user from undesirable sunshine. Those devices that do incorporate some screening device are generally constructed so that the screening element must be detached in order to collapse or fold the device.

Accordingly, it is obvious that there is a great need in the art for a portable, folding assembly which will not only support the user, but will also shade at least portions of the user's body from the sun's rays. Such an assembly should be of relatively simple but sturdy construction and should be foldable to a relatively flat configuration for storage and transportation. It would be further desirable if the assembly could be completely collapsed without the necessity of removing or detaching, any of the structural elements therefrom. It would, of course, be desirable if any fabric support elements could be removed as for cleaning or replacement due to wear.

SUMMARY OF THE INVENTION

The present invention relates to a folding frame assembly of the type suitable, when opened, for supporting the head of a user in a reclining position while at the same time shielding the user's face from direct sun rays. To accomplish this, and as will be set forth in greater detail below, the frame assembly comprises a plurality of frame means pivotally connected to each other and support and shade elements disposed in interconnecting relation between predetermined portions of the frame means.

The primary frame elements of the assembly of the subject invention comprise a back frame means and a front frame means. Both the back and the front frames comprise substantially retangular frames, the two sides of which are relatively longer than the corresponding end pieces. The back and front frame means are pivotally connected one to the other, and their point of connection is reinforced by a spacer means extending in interconnecting relation therebetween. The pivotal connection between the back and front means is made at corresponding, oppositely disposed intersecting points on their sides when the back frame is positioned within the front frame and the two bottom ends are spaced apart to define first and second base members.

In the preferred embodiment, a flexible material is disposed in interconnecting relation between the first and second base members to provide a substantially flat base when the apparatus is in its opened position. This substantially flat base serves to prevent the base members from sinking, or embedding themselves, into a relatively soft supporting suface.

The folding frame assembly further comprises a center frame means of substantially U-shaped configuration. The open ends of the center frame are pivotally connected to corresponding, oppositely disposed points on the sides of the front frame means above the pivotal connection between the back and front frames. A flxible shade extends in interconnecting relation from the top end of the back frame, to the closed end of the center frame, and finally to the top end of the front frame. When the assembly is in its opened position, this shade will serve to screen the sun's rays from the face of a user.

Finally, the assembly of the present invention comprises headrest frame means pivotally connected to the center frame means at the same points the center frame means is so connected to the front frame means. The back frame means further includes corresponding, oppositely disposed finger means formed thereon in engaging, supporting relation to predetermined portions of the headrest frame means when the assembly is unfolded. The headrest frame means is also of substantially U-shaped configuration, and the pivotal connections are made at the opened ends thereof. In order to support the user's head, a headrest is provided in interconnecting relation between the sides of the headrest frame. The headrest itself may be formed from either a flexible or substantially rigid material, for it does not have to collapse when the apparatus is folded.

While the apparatus of the present invention has thus far been described with specific regard to its use as a head support and sunshade for the face, it is to be understood that the device might be constructed on a scale large enough to support the entire weight of the user's body. That is to say, be making minor design changes, the folding assembly of the present invention might be constructed as a chair or lounge. Similarly, it sould be understood that the base, the headrest and the shade may be removably attachable to the assembly so that they may be cleaned or replaced when necessary. However, it is to be emphasized that removability of these elements is not necessry to the utility of the invention.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the follwing detailed description taken in connection with the accompanying drawings, in which.

Similar reference characters refer to similar parts throughout the several views of the drawings.

DETAILED DESCRIPTION

Figure 2:
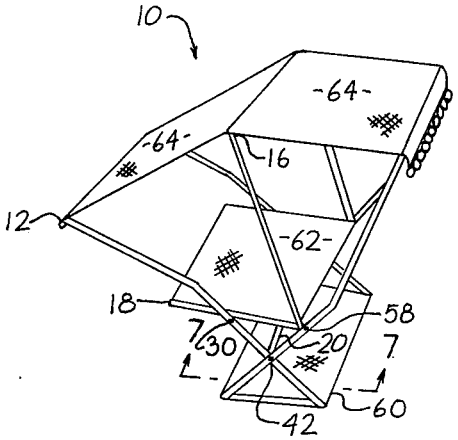
FIG. 2 is a perspective view similar to that of FIG. 1.
Figure 3:
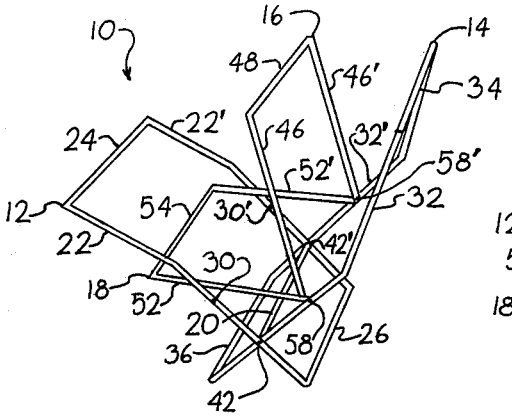
FIG. 3 is a perspective view of the frame assembly with support and shade elements removed.
Figure 4:
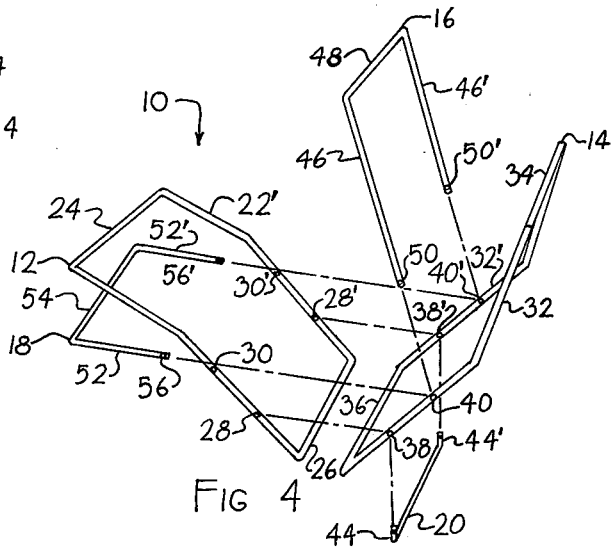
FIG. 4 is an exploded view of the frame assembly shown in FIG. 3.

The folding frame assembly of the present invention is generally indicated as 10 and perhaps best seen in the views of FIGS. 2 and 4. As shown therein, assembly 10 basically comprises back frame means 12, front frame means 14, center frame means 16, headrest frame means 18, and spacer means 20. These elements are shown in exploded view in FIG. 4. In FIG. 3 they are shown in assembled, opened position, with supporting and shading elements removed for clarity. The entire device open for use is illustrated in FIG. 2. The elements are shown in their folded configuration in the view of FIG. 5.

As best seen in the view of FIG. 4, back frame means 12 comprises a substantially rectangular figure, including sides 22 and 22', top end 24, and a bottom end comprising a first base member 26. As will be described in greater detail below, sides 22 and 22' include corresponding, oppositely disposed apertures 28 and 28' formed therethrough, and corresponding, oppositely disposed fingers 30 and 30' disposed thereon and extending inwardly.

Front frame means 14 is also of substantially rectangular configuration and includes sides 32 and 32', top end 34, and bottom end comprising a second base member 36. Corresponding, oppositely disposed front frame apertures 38 and 38' are formed in sides 32 and 32', respectively. Front frame means 14 further includes center frame apertures 40 and 40' oppositely disposed in sides 32 and 32' above front frame apertures 38 and 38'.

With specific regard to the view of FIG. 3, it could be seen that back frame means 12 and front frame means 14 are pivotally connected to each other at hinge points 42 and 42'. Of course, hinge points 42 and 42' correspond to apertures 28 and 28' and front frame apertures 38 and 38'. The pivotal connection may be accomplished by any suitable fastening means such as, for example, rivets. In the preferred embodiment illustrated, back frame means 12 fits within front frame means 14. The pivotal connection at hinge points 42 and 42' is reinforced by the placement of spacer means 20 in interconnecting relation therebetween. As most clearly seen in the view of FIG. 4, spacer means 20 includes corresponding tab portions 44 and 44' formed on the ends thereof. It is tabs 44 and 44' which are actually utilized to fix the location of the spacer means 20.

Returning now to the exploded view of FIG. 4, as shown therein center frame means 16 comprises a substantially U-shaped member including center frame sides 46 and 46' include apertures formed therein whereby center frame means 16 may be pivotally connected to front frame means 14 through corresponding center frame apertures 40 and 40'.

Headrest frame means 18 is also of a substantially U-shaped configuration and includes head frame sides 52 and 52' and head end 54. As with center frame means 16, ends 56 and 56' of head frame sides 52 and 52' also include apertures formed therethrough whereby headrest frame means 18 may also be pivotally connected to center frame means 16 and front frame means 14.

As best seen in the view of FIG. 3, assembly 10 is completed by placing center frame means 16 inside front frame means 14 and by placing headrest frame means 18 inside center frame means 16. Center frame apertures 40 and 40' are aligned with corresponding center frame ends 50 and 50' as well as head frame side ends 56 and 56'. Then, these three frame elements are pivotally connected to each other at pivot points 58 and 58= by any suitable fastening means such as, for example, rivets. It should be noted that headrest frame means 18 is positioned so that head frame sides 52 and 52' are disposed above corresponding fingers 30 and 30'. By virtue of this placement, when assembly 10 is opened as shown in FIG. 3, predetermined portions of head frame sides 52 and 52' will rest in supported, substantially horizontal position, on corresponding fingers 30 and 30' of back frame means 12.

Figure 7:
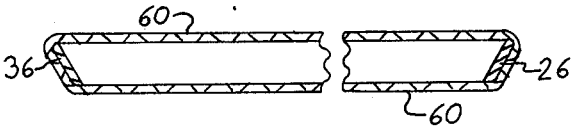
FIG. 7 is a sectional view taken along line 7—7 of FIG. 2.

Having thus described the construction of the frame elements of assembly 10, attention is invited to the view of FIG. 2, wherein the placement of supporting and shading elements is disclosed. Assembly 10 further includes a base 60 disposed in interconnecting relation between first base member 26 and second base member 36. Base 60 is preferably formed from a flexible material to facilitate folding assembly 10. As shown in the detailed view of FIG. 7, base 60 preferably comprises a sheet of flexible material disposed in surrounding relation to first base member 26 and second base member 36. By virtue of this construction of base 60, first and second base members 26 and 36 will not sink or embed themselves into a soft supporting surface, such as beach sand.

Figure 1:
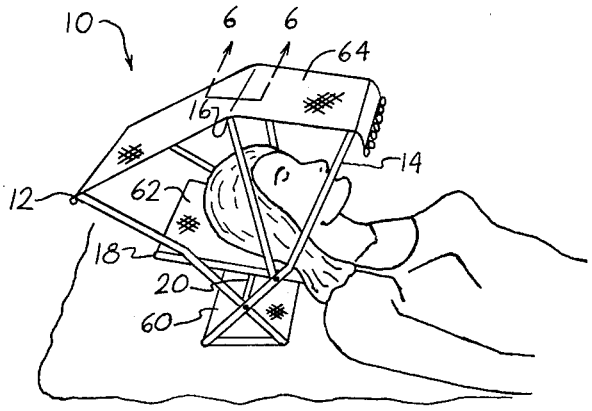
FIG. 1 is a perspective view of the frame assembly in use.

In order to support the user's head, as shown in FIG. 1, a headrest 62 is disposed in interconnecting relation between head frame sides 52 and 52'. Inasmuch as headrest 62 does not collapse when assembly 10 is folded, it may be formed from any suitable material, flexible, rigid, padded or unpadded.

Figure 6:
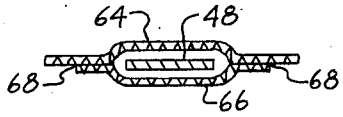
FIG. 6 is a sectional view taken along 6—6 of FIG. 1.

Finally, assembly 10 includes a shade 64 disposed in interconnecting relation between back frame top end 24, center frame top end 48 and front frame top end 34. Shade 64 is formed from a flexible material, and, as shown in the detailed view of FIG. 6, may be attached to center frame top end 48 by a reinforcing strip 66. Reinforcing strip 66 is also preferably formed from a flexible material and is attached to shade 64 by sewing indicated at seams 68. Shade 64 may be similarly attached to back frame top end 24 and front frame top end 34 by folding and sewing portions of shade 64 therearound.

While the above detailed description has been given with specific regard to a fixed attachment of base 60, headrest 62 and shade 64, it is to be understood that these elements may be removably attached to assembly 10. This, of course, could be accomplished by any suitable fastening means, such as, for example, snaps, hooks and eyes, zippers, Velcro, etc. It is not necessary that base 60, headrest 62 and shade 64 be removably attached to assembly 10, for assembly 10 is constructed so that it may be folded without the necessity of removing the supporting and shading elements.

Figure 5:
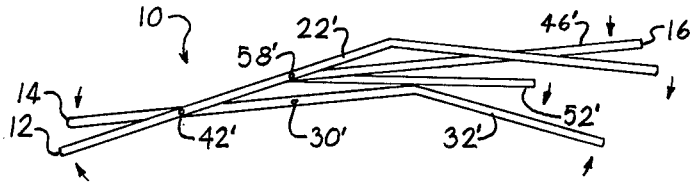
FIG. 5 is an elevation of the assembly folded for storage or transportation.

Finally, attention is invited to the view of FIG. 5, wherein assembly 10 is illustrated in its folded, substantially flat configuration for storage or transportation.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of languge, might be said to fall therebetween.

Now that the invention has been described,

What is claimed is:

1. A facial cabana comprising in combination:

a one piece rectangular back frame having an ell bend therein;

a one piece rectangular front frame having an ell bend therein;

first connecting means movably connecting said front frame to said rear frame so as to be foldable towards each other with one said bend portion being foldable in the same direction as the other said bent portion a support bar connected between said front frame and said back frame and connected thereto by said first connecting means;

a pair of U-shaped members each movably connected to said front frame by a second connecting means;

a pair of support fingers located on said back frame and adapted to have one of said pair of U-shaped members movable thereagainst to engage said support fingers in a generally horizontal position;

a flexible top connected to one end portion of said back frame member and to one end portion of said front frame member and to the other of said pair of U-shaped members to form a cover for a facial cabana frame;

a flexible portion attached to said other U-shaped member to form a head rest thereon; and a third flexible member connected between the other ends of said front frame and back frame, whereby a facial cabana is formed with a rigid foldable frame.

* * * * *